US008354658B1

(12) United States Patent
Smith et al.

(10) Patent No.: US 8,354,658 B1
(45) Date of Patent: Jan. 15, 2013

(54) LIGHTWEIGHT RADIATION ABSORBING SHIELD

(75) Inventors: Peter C. Smith, Half Moon Bay, CA (US); Steve Axelrod, Los Altos, CA (US); Paul A. Lovoi, Saratoga, CA (US)

(73) Assignee: Xoft, Inc., Sunnyvale, CA (US)

( * ) Notice: Subject to any disclaimer, the term of this patent is extended or adjusted under 35 U.S.C. 154(b) by 118 days.

(21) Appl. No.: 12/800,083

(22) Filed: May 6, 2010

Related U.S. Application Data

(63) Continuation of application No. 11/323,331, filed on Dec. 30, 2005, now abandoned, which is a continuation-in-part of application No. 11/233,921, filed on Sep. 22, 2005, now abandoned.

(51) Int. Cl.
*G21F 3/02* (2006.01)

(52) U.S. Cl. ..... 250/516.1; 250/515.1; 250/518.1

(58) Field of Classification Search ..... 250/516.1
See application file for complete search history.

(56) References Cited

U.S. PATENT DOCUMENTS

| | | | | |
|---|---|---|---|---|
| 4,194,040 | A * | 3/1980 | Breton et al. | 428/325 |
| 4,439,391 | A | 3/1984 | Hung | |
| 5,548,125 | A | 8/1996 | Sandbank | |
| 5,800,647 | A | 9/1998 | Andersen | |
| 6,310,355 | B1 | 10/2001 | Cadwalader | |
| 6,572,878 | B1 | 6/2003 | Blaine | |
| 6,703,632 | B1 * | 3/2004 | Macklis et al. | 250/515.1 |
| 6,841,791 | B2 * | 1/2005 | DeMeo et al. | 250/515.1 |
| 2002/0179860 | A1 * | 12/2002 | Smith | 250/515.1 |
| 2004/0029998 | A1 | 2/2004 | Tomita et al. | |

* cited by examiner

*Primary Examiner* — Phillip A Johnston
(74) *Attorney, Agent, or Firm* — William A. Loginov, Esq.; Loginov & Associates, PLLC

(57) ABSTRACT

A flexible, lightweight radiation absorbing sheet or shield includes heavy metal particles in one layer and mid-atomic number particles in another layer, the layer that will be adjacent to the patient. The shield is particularly intended for protection of the wearer and others from radiation emanating from a therapeutic source positioned within the patient's body. With the disclosed multi-layer shield construction, backscattered radiation off the heavy metal particle layer, affecting the patient's adjacent tissue, is minimized.

26 Claims, 2 Drawing Sheets

LIGHTWEIGHT RADIATION ABSORBING SHIELD

This application is a continuation of application Ser. No. 11/323,331, filed Dec. 30, 2005, now abandoned, which was a continuation-in-part of application Ser. No. 11/233,921, filed Sep. 22, 2005 now abandoned.

BACKGROUND OF THE INVENTION

This invention concerns the absorption of radiation, such as x-ray radiation, using a flexible shield. Particularly, the invention is concerned with a lightweight, very thin and flexible non-lead radiation shield, worn against a patient while radiation therapy is administered internally to the patient, and with protection against the effects of backscatter radiation on the patient.

Shields for protection of patients and medical workers against excessive doses of radiation, particularly in dentists' offices and other x-ray imaging or therapy situations, are well known. Heavy and relatively stiff lead shields have been typical for this purpose.

Shields of lighter weight and greater flexibility have also been used. U.S. Pat. Nos. 4,938,233, 6,048,379 and 6,674,087 disclose various radiation shields, some of which employ tungsten or other heavy metal particles suspended in a polymeric flexible medium, such as silicone.

Experimental results have indicated that radiation at, for example, 50 kVp, absorbed in a shield formed of such heavy metal particles, generates an undesirable backscattered radiation dose. For the situation where radiation is administered from a source within the patient, the backscattered radiation dose is absorbed in adjacent tissue, particularly the patient's skin adjacent to the shield. The current disclosure includes improvements to the flexible absorber design to minimize this undesirable and potentially damaging effect.

SUMMARY OF THE INVENTION

The invention now described encompasses a lightweight, very thin and flexible radiation shield which includes, in flexible media, a layer including high atomic number particles and a layer including mid atomic number particles.

Measurements indicate that backscattered radiation is largely limited to low-energy photons. The invention includes the incorporation of a thin layer or layers of solid mid atomic number absorber particles carried in a polymer incorporated into the patient side of the absorber panel. In use, impinging high energy x-ray photons pass into the absorber through the thin layer of mid atomic number particles. Backscattered radiation from this thin layer is minimal. As x-rays pass into the heavy atomic number absorber, they are absorbed, and any backward-emitted low energy backscatter radiation is in turn largely absorbed by the mid atomic number layer or layers of the invention.

A preferred embodiment of the invention involves the use of a first, patient-adjacent layer with a thin silicone polymer carrier that is loaded with fine metal particles. Ideally these metal particles have significant content of the mid atomic number elements Fe, Co, or Ni due to their inherent radiation absorption edges. As the layer should also remain non-toxic, food grade Fe, Fe oxides, and/or stainless steel powders are ideal. The powders are mixed with liquid silicone rubber, and applied to the absorber device in a thin film.

A second layer more remote from contact with the patient includes high atomic number particles, such as tungsten, again in a flexible medium such as silicone. The entire composite of multiple layers, in a preferred embodiment, is not greater than about 2 mm in thickness.

In one specific embodiment of the invention the flexible shield is used in conjunction with one or more dosimeters, placed adjacent to the patient's skin. The dosimeters can be incorporated into the shield, at or very close to the patient side of the shield. These dosimeters can provide feedback for verification of dose at the skin, and for control of the dose.

It is thus among the objects of this invention to improve in the convenience of use and in the performance and effectiveness of non-lead flexible radiation shields, particularly for the case where radiation is administered inside the patient and backscatter is an important concern. These and other objects, advantages and features of the invention will be apparent from the following description of preferred embodiments, considered along with the drawings.

DESCRIPTION OF PREFERRED EMBODIMENTS

Figure 1:
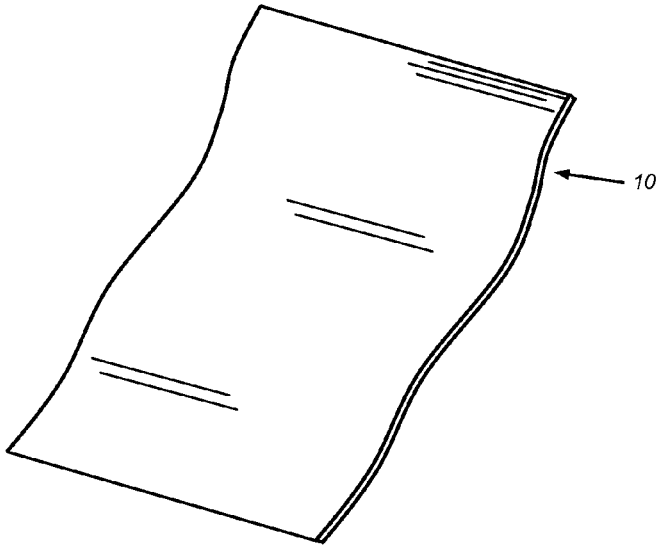
FIG. 1 is a perspective view showing a radiation absorbing shield according to the invention.

In the drawings, FIG. 1 shows a radiation attenuating shield 10 of the invention, comprising a flexible, flimsy and thin sheet of material, preferably about 2 mm maximum in thickness, for laying against a patient experiencing internal radiation therapy, such as using an x-ray source within a cavity or lumen of the body. The sheet 10 is flexible and conformable enough, and heavy enough in weight, such that it readily conforms to the body when placed against the skin.

Figure 2:
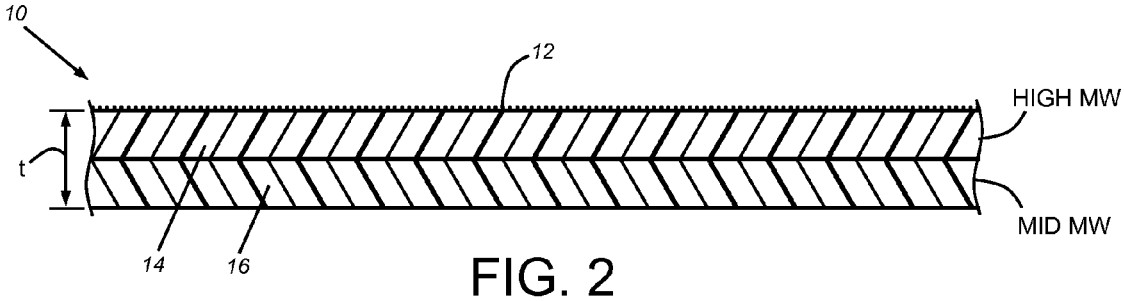
FIG. 2 is a schematic view showing the shield of FIG. 1 in cross-section.

FIG. 2 is a schematic view in cross-section showing an example of preferred construction for the sheet of material 10. The flexible radiation shield 10 preferably has an outer skin 12 of a fabric material, which may be a woven fabric material. In a preferred embodiment this material is stretchable, and the material may be any of several known stretchable elastic fabrics such as LYCRA. This outer skin fabric layer 12 is adhered to the outer surface of a layer 14, which is in turn secured to or integral with a layer 16, the latter being the side of the shield 10 that is placed directly against the patient. The layer 16 can be called a first layer or patient-adjacent layer, and the layer 14 can be called a second layer or patient-remote layer. Although the two layers 14 and 16 have different composition, they act essentially as a single layer.

In one preferred implementation the overall thickness t of the flexible radiation shield 10 is no more than about 2 mm, and can be even less.

Of the two layers 14 and 16, these in one preferred embodiment are both soft silicone, such as very soft Shore A5 medical grade silicone. In one preferred embodiment the layer 14, more remote from the patient, is filled with ninety percent by weight tungsten powder, carried in the silicone host. The tungsten powder in one embodiment is minus 100 mesh sintered tungsten metal, mixed with the liquid silicone and molded into sheets or shapes suitable for the absorber application. Breast shapes, i.e. cup shapes, have also been produced of this material. Such a layer alone, only about 1 millimeter in thickness, has been shown to attenuate x-rays of 45 kVp by a factor of greater than ten thousand.

Because a single layer such as the layer 14 described above tends to generate an undesirable backscatter radiation dose to adjacent tissue when x-rays at about 45 to 50 kVp are primarily being absorbed, the flexible radiation shield of the invention includes the layer 16, also preferably a layer with a soft silicone host. The layer 16 comprises at least one layer having solid mid-atomic number absorber particles, and this layer (or layers) 16 is placed against the patient. In one preferred embodiment the mid-atomic number particles comprise about fifty percent by weight of the entire layer, the balance being the same soft medical grade silicone described above relative to the layer 14. The mid-atomic number particles preferably are at least as small as minus 100 mesh (149 microns in diameter), and more preferably about 400 mesh (37 microns). A preferred size range is about 35 to about 150 microns. They may be, for example, any of the following metals alone or in mixtures, including compounds of any of the metals: iron, nickel and cobalt and other elements of similar atomic number. Iron, nickel and cobalt match have absorption that matches the absorption and re-emission of characteristic lines and radiation of tungsten. Since the layer should remain non-toxic, food grade iron oxides and/or stainless steel powders are advantageously used. These powders are mixed with liquid silicone rubber, and can be applied against the layer 14 in a thin film, essentially integrating the two silicone layers together. Alternatively, the layer 14 can be applied against a previously produced layer 16.

Tests of a composite flexible radiation absorber shield 10, produced in accordance with the example given above, revealed, at 50 kVp radiation, a significant reduction of backscatter. Most of the x-ray radiation at 50 kVp appears to pass through the patient-adjacent layer 16, and of the radiation which does, nearly all is absorbed in the layer 14 (with greater than 10,000 to 1 reduction based on radiation which is able to transmit through the entire shield 10). As noted above, a small percentage of the radiation striking the high molecular weight layer 14 is backscattered back toward the patient, and nearly all of this backscatter is absorbed as it travels back through the mid-molecular weight layer 16 adjacent to the patient. Backscattered radiation from the mid-molecular weight layer 16, from the initially impinging radiation, is minimal.

In other embodiments other polymers can be used as carriers or hosts for the layers of high molecular weight and mid-molecular weight absorber materials. Wax layers have been produced, for disposable use and preferably shaped to the patient's breasts or other organ or body feature where radiation is being internally administered. This type of shield is castable to the shape desired and produces a semi-hard absorber structure, of relatively low cost. Also, shields can be produced with much lower proportions of radiation attenuating metals, and these structures may be used in contrast enhancing, marker or filter applications.

The absorber 10 constructed as in FIG. 2, with layers 12, 14 and 16 and the described very soft silicone host material, is very flimsy, easily trimmable, and conformal enough such that it forms itself around most anatomic structures (breasts, ribs and torso, shoulders, hands, face, etc.) This conformability is consistent with the material's ability to stretch, in a preferred embodiment, up to 200% elongation and to elastically return to shape. The material is cleanable, and suitable for reusable article service, although it can be disposable if desired and in many cases it will be cut by the surgeon and in such cases will be used only once.

In another embodiment, the flexible radiation shield structure 10 shown in FIG. 2, with silicone composite layers, can be a portion of a further liquid silicone rubber overmolded structure used selectively to shield (or to irradiate) specific parts of anatomy. The overmolding can be in the form of a colored cover, as in a tinted silicone coating, rather than the stretchable elastic fabric.

A graded absorber shield structure may be produced for certain applications. In this form the shield is created with co-bonded regions that have tungsten filler adjacent to regions that have no filler. The result is an absorber with selective absorption which may be of value in certain radiation treatment applications.

Functionally composite structures including adhesives can form an integral part of the shield. For example, adhesive (covered by a releasable backing sheet) can be in selected areas of the skin side of the shield, where the surgeon is likely to cut the shield to make the patient incision. The adhesive helps permit closure of any gaps.

Figure 3:
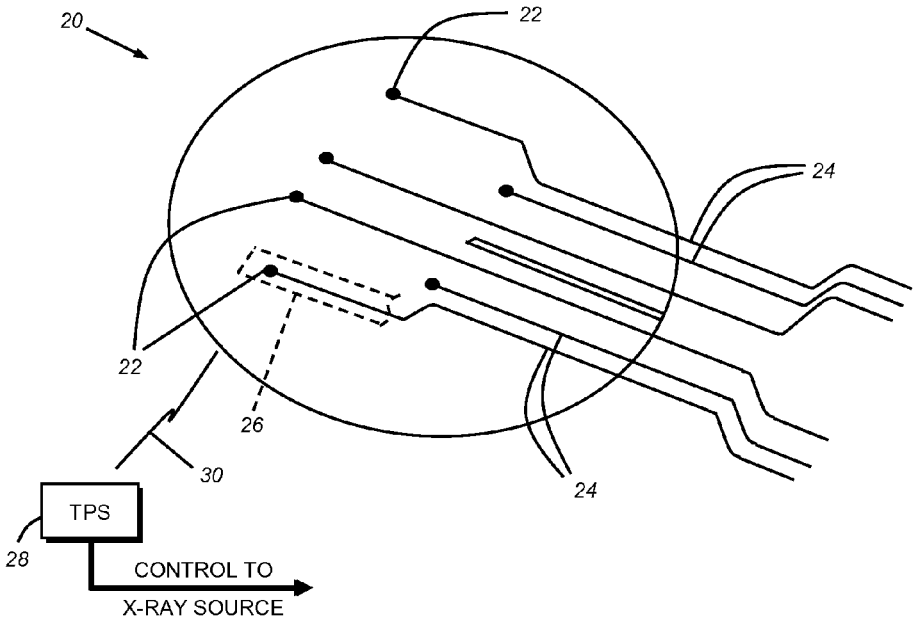
FIG. 3 is a schematic view showing dosimeters incorporated in a radiation shield of the invention, at the skin side.

FIG. 3 illustrates schematically an embodiment of the invention wherein a flexible radiation absorption shield 20, constructed in the manner described above, incorporates one or more dosimeters 22 in the shield.

The flexible radiation shield for the breast application covers the breast and reduces the dose leaving the patient during the treatment. This shield will allow the doctor, attending staff and friends to be with the patient during treatment. The shield has features that reduce the secondary scattering dose at the interface between the high Z material absorber and the patient's skin. Placing a miniature dosimeter on the patient's skin over the applicator will allow a verification of the dose delivered and especially the dose to the skin. Due to the backscatter dose that is developed because of the high Z shield, obtaining an accurate dose at the skin surface depends on how the x-rays interact with the dosimeter. Having optimized low and intermediate Z materials surrounding the detector is critical to achieving accurate dosimetry; the dosimeter(s) can be shielded from receiving backscatter. The miniature dosimeter 22 or dosimeters can be integrated into the flexible shield so that they are one component, as shown in FIG. 3, or they can be separate, contained in a separate mat or sheet similar to what is shown in FIG. 3, but usually smaller than the shield itself, which will lie over (outside) the detector sheet. The detector sheet can include shielding of the dosimeters against backscatter from the shield.

If the dosimeter is integrated into the skin side of the shield as preferred, the path of the dosimeter cable can be marked with a bright contrasting color line printed on the shield, as along the lines 24 seen in FIG. 3. The detector active area can be positioned precisely and also marked on the absorber (at locations 22). To further avoid damage to the sensor and/or its cable 24 a stripe of protection (indicated partially at 26) can be added on or built in so that it protects the components from cutting in preparation for surgery. This protection stripe or shield (or several of them) could be made from Kevlar, for example.

More than one detector can be installed in the shield, as indicated in FIG. 3, to further verify the delivered skin dose from the primary radiation.

The dosimeters on the surface, between the skin and shield, can also be used for mapping and feedback control. In the mapping mode the x-ray source or sources can be run at their intended high voltage but at a reduced source current, to reduce the dose, but to indicate the dose that would be delivered at full source current. The sources would be run as indicated at all dwell positions and the total delivered dose would be recorded. This mode can accurately predict the total dose that will be delivered at the skin at selected locations when the source or sources are run at full power, time and dwell positions.

In the feedback control mode, the dosimeter readings can be used in real time to control the source's output to achieve a desired total dose. When the dose at a given dosimeter reaches the desired level, the source can be changed in current or position. FIG. 3 indicates schematically a treatment planning system 28 (including a computer and programming), which can be connected by wire to the wire leads 24 of the dosimeters, or, as indicated at 30, which can be in wireless communication with the dosimeters 22, without the need for the wires 24. The initial plan delivered from the TPS 28 can be modified by the readings at the dosimeters as follows. The TPS will predict the dose to be received by the dosimeters 22 as well as optimizing the dwell positions, dwell times and x-ray source voltages. This optimized plan, sometimes called a reverse plan, will predict the dose at the dosimeters. When the trial dose is delivered (or the real dose in real time), then the predicted dose at dosimeters (either after all the dose at a dwell point is delivered or after only one dwell point or after only a partial dwell point, which may be the first or any other dwell point) can be compared to the detected dose, and differences detected and the treatment plan changed accordingly, either in a preliminary step or during the actual treatment.

The above described preferred embodiments are intended to illustrate the principles of the invention, but not to limit its scope. Other embodiments and variations to these preferred embodiments will be apparent to those skilled in the art and may be made without departing from the spirit and scope of the invention as defined in the following claims.

We claim:

1. A flexible, thin and lightweight radiation absorbing shield to be worn against a patient's body to protect against radiation emitted internally in the patient during internal radiation therapy within the patient's body, comprising:

a matrix of flexible material which defines at least two radiation attenuating layers, a first, patient-adjacent layer at a side of the radiation shield intended to be placed against the patient and carrying absorber particles of mid atomic number, and an adjacent layer carrying radiation absorber particles of high atomic number, positioned to be more remote from the patient than the first layer;

said attenuating layers being configured to protect the patient's skin by blocking internally emitted radiation backscattered from the layer carrying the high atomic number particles.

2. The radiation shield of claim 1, wherein the total thickness of the shield is not greater than about 2 mm.

3. The radiation shield of claim 1, wherein the flexible matrix comprises silicone.

4. The radiation shield of claim 3, wherein the silicone content of the matrix is in the range of about 5 to 75 percent.

5. The radiation shield of claim 1, wherein the high atomic number absorber particles comprise tungsten metal, and wherein the mid atomic number absorber particles comprise, alone or in combination, iron, nickel, cobalt or compounds thereof.

6. The radiation shield of claim 5, wherein the mid atomic number absorber particles include iron oxide.

7. The radiation shield of claim 1, wherein the absorber particles are of a size between about 35 and about 150 microns in diameter.

8. The radiation shield of claim 1, wherein the first layer having the mid atomic number absorber particles is less than about 5 mils thick.

9. The radiation shield of claim 1, wherein the matrix material comprises wax, providing a moldable shield material.

10. The radiation shield of claim 1, wherein the radiation shield absorbs more than fifty percent of x-ray radiation at about 50 kVp.

11. The radiation shield of claim 1, wherein the high atomic number radiation absorber particles are nonuniformly distributed in said adjacent layer, creating an absorber with regions of greater and lesser radiation absorption, for specialized applications.

12. The radiation shield of claim 1, wherein the matrix is stretchable more than 200% with return to an original shape.

13. The radiation shield of claim 12, further including a cover sheet against the first layer, the cover sheet being of stretchable fabric.

14. The radiation shield of claim 13, wherein the shield is washable without damage.

15. The radiation shield of claim 1, further including at least one dosimeter incorporated into the first layer near the patient side of the shield, with lead wires extending from the dosimeter to the exterior of the shield.

16. The radiation shield of claim 15, further including visible marking on an exterior surface of the shield, indicating positions of dosimeters and lead wires.

17. The radiation shield of claim 1, further including at least one dosimeter incorporated into the first layer near the patient side of the shield, and including shielding of the dosimeter against radiation backscattered from the radiation absorbing shield.

18. The radiation shield of claim 1, wherein the first layer contains said absorber particles of mid atomic number in such density as to pass most x-ray radiation at 50 kVp through to the adjacent, more remote layer, and in such density as to absorb substantially all x-ray radiation backscattered off the adjacent more remote layer and back into the first layer.

19. A method for protecting a patient's skin from radiation emitted internally in the patient during internal radiation therapy within the patient's body, comprising:

placing against the patient a flexible, thin and lightweight radiation absorbing shield, the shield comprising a matrix of flexible material which defines at least two radiation attenuating layers, a first, patient-adjacent layer at a side of the radiation shield placed against the patient and carrying absorber particles of mid atomic number, and an adjacent layer carrying radiation absorber particles of high atomic number, positioned more remote from the patient than the first layer, and irradiating the patient internally with x-ray radiation, causing some of the radiation to penetrate out through the patient's skin and, with the radiation shield, absorbing most high energy radiation with the layer having high atomic number radiation absorber particles but causing some backscatter of low-energy radiation back toward the patient and into the mid atomic number layer, where the low-energy radiation is absorbed, thus protecting the patient's skin against backscatter radiation.

20. The method of claim 19, wherein the first layer contains said absorber particles of mid atomic number in such density as to pass most x-ray radiation at 50 kVp through to the adjacent, more remote layer, and in such density as to absorb substantially all x-ray radiation backscattered off the adjacent more remote layer and back into the first layer.

21. The method of claim 19, wherein the radiation shield absorbs more than fifty percent of x-ray radiation at about 50 kVp.

22. The method of claim 19, wherein the total thickness of the shield is not greater than about 2 mm.

23. The radiation shield of claim 1 wherein the high atomic number absorber particles comprise tungsten metal, wherein the mid atomic number absorber particles comprise, alone or in combination, iron, nickel, cobalt or compounds thereof, wherein each layer of the matrix comprises a like polymer material, and wherein the percentage of absorber particles is greater in the adjacent layer than in the first patient-adjacent layer.

24. The radiation shield of claim 23 wherein the percentage of absorber particles in the more remote adjacent layer is on the order of ninety percent with the remainder being the polymer material.

25. The radiation shield of claim 23 wherein the percentage of absorber particles in the patient-adjacent layer is on the order of fifty percent with the remainder being the polymer material.

26. The radiation shield of claim 1 wherein a small percentage of the radiation striking the layer carrying high atomic number particles is backscattered back toward the patient, and nearly all of this backscattered radiation is absorbed as it travels back through the layer carrying mid atomic number particles to the patient.

* * * * *